US009636795B2

(12) United States Patent
Kikuchi

(10) Patent No.: US 9,636,795 B2
(45) Date of Patent: May 2, 2017

(54) METHOD OF EDGING A SPECTACLE LENS, SPECTACLE LENS EDGING SYSTEM AND SPECTACLE LENS EDGING PROGRAM

(71) Applicant: HOYA CORPORATION, Tokyo (JP)

(72) Inventor: Yoshihiro Kikuchi, Tokyo (JP)

(73) Assignee: HOYA CORPORATION, Tokyo (JP)

( * ) Notice: Subject to any disclaimer, the term of this patent is extended or adjusted under 35 U.S.C. 154(b) by 535 days.

(21) Appl. No.: 13/849,814

(22) Filed: Mar. 25, 2013

(65) Prior Publication Data

US 2013/0260642 A1 Oct. 3, 2013

(30) Foreign Application Priority Data

Mar. 29, 2012 (JP) ..... 2012-076753

(51) Int. Cl.
*G06F 19/00* (2011.01)
*B24B 9/14* (2006.01)
*B24B 49/00* (2012.01)

(52) U.S. Cl.
CPC ..... *B24B 9/144* (2013.01); *B24B 9/148* (2013.01); *B24B 49/00* (2013.01)

(58) Field of Classification Search
CPC ..... B24B 9/144
USPC ..... 351/41, 159.01, 159.75, 178
See application file for complete search history.

(56) References Cited

U.S. PATENT DOCUMENTS

2011/0149234 A1* 6/2011 Biton et al. ..... 351/177

FOREIGN PATENT DOCUMENTS

| | | | | |
|---|---|---|---|---|
| JP | H06-74748 A | 3/1994 | | |
| JP | B2-3075870 | 6/2000 | | |
| JP | 2000-187185 A | 7/2000 | | |
| JP | EP 1147853 A1 * | 10/2001 | ..... | B24B 9/148 |
| JP | 2008-065262 A | 3/2008 | | |

* cited by examiner

*Primary Examiner* — Carlos Ortiz Rodriguez
*Assistant Examiner* — Sheela S Rao
(74) *Attorney, Agent, or Firm* — Oliff PLC

(57) ABSTRACT

A controller 240 that gives an instruction of edging a spectacle lens, to a lens edger based on frame shape data outputted from a spectacle frame measuring machine, includes: recognition parts 240*a*, 240*b* that recognize a positional relation between a groove shape of the spectacle frame whose frame shape data is measured, and a measurement reference point being a reference when measuring the frame shape data, and a positional relation between a beveling instruction reference point being a reference when a beveling instruction is given to the lens edger and a bevel shape obtained by the beveling; and a beveling amount correcting part 240*d* that corrects a beveling amount when giving an instruction of beveling to the lens edger based on each positional relation recognized by the recognition parts 240*a*, 240*b*, so that the bevel shape is fitted into the groove shape.

9 Claims, 5 Drawing Sheets

METHOD OF EDGING A SPECTACLE LENS, SPECTACLE LENS EDGING SYSTEM AND SPECTACLE LENS EDGING PROGRAM

BACKGROUND

Technical Field

The present invention relates to a method of edging a spectacle lens, a spectacle lens edging system and a spectacle lens edging program for applying a beveling process to a spectacle lens.

Description of Related Art

A spectacle lens framed into a spectacle frame is formed by being subjected to an edging process applied to an uncut lens. An edging process includes "edging" for cutting and polishing the uncut lens so as to match a spectacle frame shape, and "beveling" for providing a bevel on an edged lens.

Such an edging process is performed based on frame shape data of a spectacle frame. Namely, the edging process and the beveling process are performed so as to match a groove shape of the spectacle frame specified by the frame shape data.

As described above, conventionally, the spectacle lens with a bevel is supplied by applying the edging process and the beveling process to the uncut lens, based on the frame shape data of the spectacle frame (for example, see patent document 1).

Patent document 1; U.S. Pat. No. 3,075,870

In recent years, the groove shape of the spectacle frame is not necessarily equalized, and for example various groove shapes (such as V-shaped groove and U-shaped groove) are distributed. Such a difference in the groove shape has a large influence on a measurement precision of the frame shape data of the spectacle frame. This is because if the groove shape is different, a positional relation between a measurement reference point (reference point uniquely determined from a position of a probe) estimated by a spectacle frame measuring machine, and an actually measured groove shape (particularly a groove tip point), even if the same spectacle frame measuring machine is used.

The same thing can be said for not only the difference in the groove shape, but also the difference in a type of the spectacle frame machine. It is general that the shape of the probe in the spectacle frame measuring machine is different depending on the type of the spectacle frame measuring machine, and which locus of the probe passing through a certain position is employed as the measurement reference point is also different depending on the type. Accordingly, the positional relation between the measurement reference point estimated by the spectacle frame measuring machine, and the actually measured groove shape (particularly the groove top point) is different if the spectacle frame measuring machine of a different type is used to perform measurement, even if the groove shape is the same.

Meanwhile, the same thing can be said for a lens edger that performs the edging process and the beveling process to the uncut lens. Namely, although various types exist as well regarding the lens edger, not only the formed bevel shape (particularly a top point angle of the bevel (120°, 118°, 110° . . . , etc.)) is different, but also the positional relation between a beveling instruction reference point (reference point uniquely determined by the type of the lens edger) for giving a beveling instruction, and the bevel shape (particularly the top point of the bevel) obtained by this beveling process is also different.

Under such a circumstance, the spectacle lens after beveling cannot be precisely fitted into the spectacle frame, depending on a combination of the groove shape of the spectacle lens, the type of the spectacle frame measuring machine to be used and the type of the lens edger to be used when the spectacle lens with a bevel is supplied, and therefore an edging size alignment by an actual body alignment is sometimes required. Such a case invites a situation that a complicated work of aligning the edging size by the actual body alignment is required, thereby also inviting a complicated work such as a product management and management of an edging step, because an actual body alignment process is interposed according to the above-mentioned combination. Further, there is absolutely neither flexibility nor versatility such as an interrupted edging is consecutively performed by a lens edger of other type in the middle of the edging step. When an edging size failure is generated under such a circumstance, it is extremely difficult to specify the cause thereof, and therefore it is also extremely difficult to cope with the size failure.

Therefore, an object of the present invention is to provide a method of edging a spectacle lens, a spectacle lens edging system and a spectacle lens edging program, capable of improving a fitting ratio into a spectacle frame of a spectacle lens after beveling, and realizing a supply of a beveled spectacle lens with a stable good quality.

SUMMARY OF THE INVENTION

In order to achieve the above-described object, inventors or the present invention examine a factor of a situation in which a spectacle lens after beveling cannot be accurately fitted into a spectacle frame, depending on a combination of a groove shape of a spectacle frame, the type of a spectacle frame measuring machine to be used and the type of a lens edger to be used. Such a situation is probably caused by a deviation, etc., generated in the estimated positional relation between a groove shape of the spectacle frame and a bevel shape corresponding thereto, due to a difference in a specific groove shape and types of the spectacle frame measuring machine or the lens edger. Therefore, the inventors of the present invention employs a completely new concept in a technical field of a conventional spectacle lens as follows: namely, an actual fitting mode between the groove shape of the spectacle frame and the bevel shape after beveling is recognized in comprehensive consideration of a series of process from acquisition of frame shape data of the spectacle frame, to giving a beveling instruction to the lens edger, irrespective of a conventional general technical common sense such as acquisition of data and giving the beveling instruction, etc., based on a specification of each type, to thereby correct a beveling amount in the beveling process, and obtains a concept that a fitting ratio into the spectacle frame of the spectacle lens after beveling, can be improved without being influenced by the groove shape and the difference in the type.

The present invention is provided based on such a new concept by the inventors of the present invention.

According to a first aspect of the present invention, there is provided a method of edging a spectacle lens that performs beveling to a spectacle lens using a lens edger based on frame shape data of a spectacle frame; including:

recognizing a positional relation between a groove shape of the spectacle frame whose frame shape data is measured and a measurement reference point being a reference when the frame shape data is measured, and a positional relation between a beveling instruction reference point being a reference when the beveling instruction is given to the lens edger and a bevel shape obtained by the beveling; and correcting a beveling amount so that the bevel shape is fitted into the groove shape based on the recognized each positional relation when the beveling instruction is given to the lens edger.

According to a second aspect of the present invention, there is provided the method of the first aspect, wherein the beveling amount is corrected so that the bevel shape is fitted into the groove shape, in consideration of an inclination amount between the groove shape and the bevel shape.

According to a third aspect of the present invention, there is provided a spectacle lens edging system, including:

a spectacle frame measuring machine configured to measure a frame shape of a spectacle frame and output frame shape data;

a lens edger configured to perform beveling to a spectacle lens;

a controller configured to give an instruction of beveling the spectacle lens, to the lens edger based on the frame shape data outputted from the spectacle frame measuring machine.

the controller further including:

a recognition part that recognizes a positional relation between a groove shape of the spectacle frame whose frame shape data is measured, and a measurement reference point being a reference when measuring the frame shape data, and a positional relation between a beveling instruction reference point being a reference when a beveling instruction is given to the lens edger and a bevel shape obtained by the beveling; and a beveling amount correcting part that corrects a beveling amount based on each positional relation recognized by the recognition part, so that the bevel shape is fitted into the groove shape when the beveling instruction is given to the lens edger.

According to a fourth aspect of the present invention, there is provided a spectacle lens edging program for causing a computer used by being connected to a spectacle frame measuring machine that measures a frame shape of a spectacle frame and outputs frame shape data, and a lens edger that performs beveling to a spectacle lens, to function as:

a beveling instruction part that gives an instruction of beveling the spectacle lens, to the lens edger based on the frame shape data outputted from the spectacle frame measuring machine;

a recognition part that recognizes a positional relation between a groove shape of the spectacle frame whose frame shape data is measured, and a measurement reference point being a reference when measuring the frame shape data, and a positional relation between a beveling instruction reference point being a reference when a beveling instruction is given to the lens edger and a bevel shape obtained by the beveling; and a beveling amount correcting part that corrects a beveling amount based on each positional relation recognized by the recognition part, so that the bevel shape is fitted into the groove shape when the beveling instruction is given to the lens edger.

According to a fifth aspect of the present invention, there is provided a method of edging a spectacle lens for performing beveling to a spectacle lens by a lens edger based on frame shape data of the spectacle frame, including:

a first recognizing step of recognizing a positional relation between a groove shape of the spectacle lens whose frame shape data is measured, and a measurement reference point being a reference when the frame shape data is measured;

a second recognizing step of recognizing a positional relation between a beveling instruction reference point being a reference when a beveling instruction is given to the lens edger, and a bevel shape obtained by the beveling;

a third recognizing step of recognizing a fitting mode between the groove shape and the bevel shape, based on a recognition result in the first recognizing step, and a recognition result in the second recognizing step; and a beveling amount correcting step of correcting a beveling amount when the beveling instruction is given to the lens edger so that the bevel shape is fitted into the groove shape, based on a recognition result in the third recognizing step; and a beveling instruction step of giving an instruction of beveling, to the lens edger based on a beveling amount after being corrected in the beveling amount correcting step.

According to a sixth aspect of the present invention, there is provided the method of edging a spectacle lens according to the fifth aspect, wherein the fitting mode is recognized in the third recognizing step, in consideration of an inclination amount between the groove shape and the bevel shape.

According to a seventh aspect of the present invention, there is provided a spectacle lens edging system, including:

a spectacle frame measuring machine configured to measure a frame shape of a spectacle frame and output frame shape data;

a lens edger configured to perform beveling to a spectacle lens; and a controller configured to give an instruction of beveling the spectacle lens, to the lens edger based on the frame shape data outputted from the spectacle frame measuring machine, the controller further including:

a first recognition part that recognizes a positional relation between a groove shape of the spectacle frame whose frame shape data is measured and a measurement reference point being a reference when measuring the frame shape data;

a second recognition part that recognizes a positional relation between a beveling instruction reference point being a reference when the beveling instruction is given to the lens edger, and a bevel shape obtained by the beveling;

a third recognition part that recognizes a fitting mode between the groove shape and the bevel shape, based on a recognition result in the first recognition part and a recognition result in the second recognition part;

a beveling amount correcting part that corrects a beveling amount based on a recognition result in the third recognition part, so that the bevel shape is fitted into the groove shape when the beveling instruction is given to the lens edger; and a beveling instruction part that gives the beveling instruction to the lens edger based on the beveling amount after being corrected in the beveling amount correcting part.

According to an eighth aspect of the present invention, there is provided a spectacle lens edging program for causing a computer used by being connected to a spectacle frame measuring machine that measures a frame shape of a spectacle frame and outputs frame shape data, and a lens edger that performs beveling to a spectacle lens, to function as:

a first recognition part that recognizes a positional relation between a groove shape of the spectacle frame whose frame shape data is measured, and a measurement reference point being a reference when the frame shape data is measured;

a second recognition part that recognizes a positional relation between a beveling instruction reference point being a reference when a beveling instruction is given to the lens edger, and a bevel shape obtained by the edging;

a third recognition part that recognizes a fitting mode between the groove shape and the bevel shape, based on a recognition result in the first recognition part and a recognition result in the second recognition part;

a beveling amount correcting part that corrects a beveling amount based on a recognition result in the third recognition part, so that the bevel shape is fitted into the groove shape when the beveling instruction is given to the lens edger; and a beveling instruction part that gives the beveling instruction to the lens edger based on a beveling amount after being corrected by the beveling amount correcting part.

According to the present invention, the fitting ratio into the spectacle frame of the spectacle lens after beveling, can be improved irrespective of the groove shape of the spectacle frame, the type of the spectacle frame measuring machine to be used and the type of the lens edger to be used, and the supply of the beveled spectacle lens with a stable good quality can be realized.

DETAILED DESCRIPTION OF THE INVENTION

An embodiment of the present invention will be described hereafter, based on the drawings.

In this embodiment, explanation is given by classifying the contents into items in the following order.

1. System structure
2. Functional structure
3. Procedure of a method of edging a spectacle lens
4. Effect of this embodiment
5. Modified example, etc.

<1. System Structure>

First, an overall structure of a system in this embodiment will be described.

Figure 1:
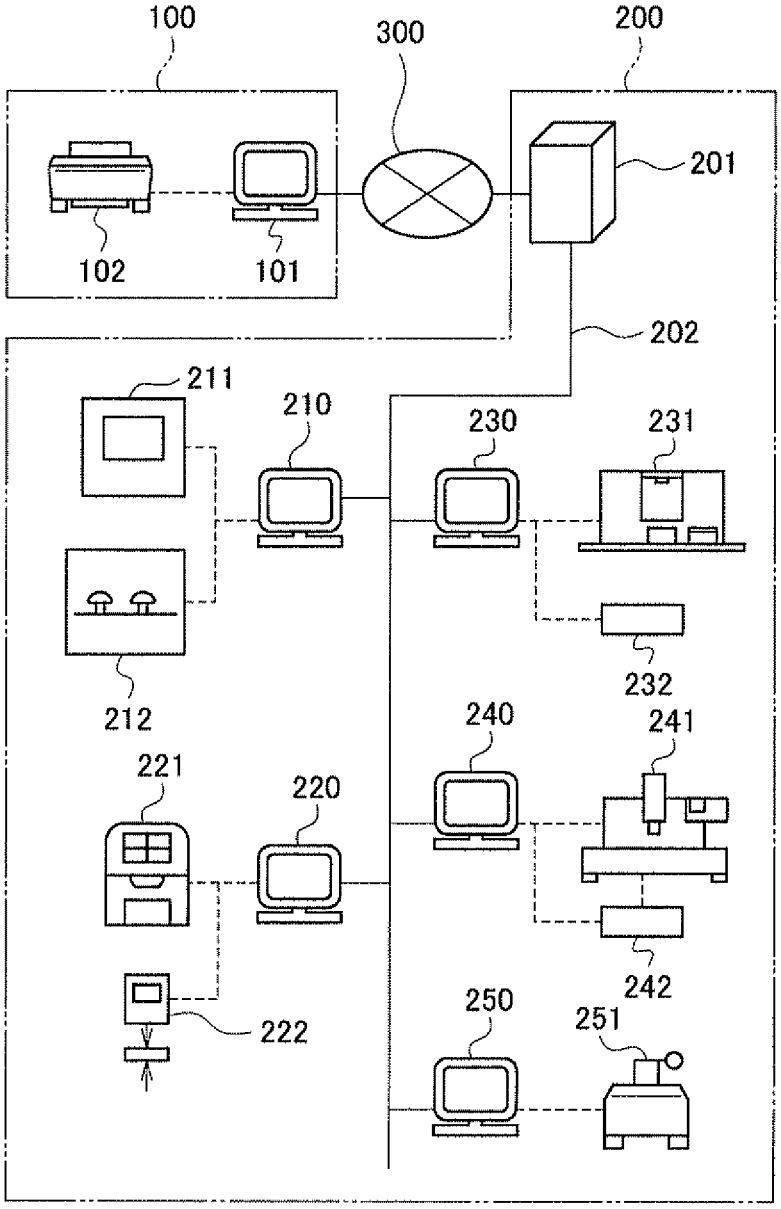
FIG. 1 is an overall block diagram of a supply system of a spectacle lens employing a method of edging a spectacle lens according to the present invention.

FIG. 1 is an overall block diagram of a supply system of a spectacle lens in which the method of edging a spectacle lens of the present invention is executed.

(Overall Structure)

As shown in FIG. 1, the supply system of a spectacle lens given as an example according to this embodiment, has a structure in which a spectacle shop 100 being an order side of a spectacle lens, and a factory 200 of a lens manufacturer being a lens edging side, are dispersedly arranged. In the figure, although only one spectacle shop 100 is shown, actually there may be a plurality of spectacle shops 100 per one factory 200.

(Spectacle Shop Side Structure)

A terminal computer 101 for online use, and a spectacle frame measuring machine 102 for measuring a frame shape of a spectacle frame and outputting frame shape data, are installed in the spectacle shop 100.

The terminal computer 101 includes an input device such as a keyboard and a mouse, etc., and a display device such as a liquid crystal panel, etc., and is connected to the factory 200 side through a public communication line network 300, to thereby perform transmission/reception of data between the factory 200 and the terminal computer 101.

The spectacle frame measuring machine 102 is configured to make a probe brought into contact with frame grooves (bevel grooves) of right and left frames of the spectacle frame, and rotate the probe around a specific point, and three-dimensionally detect cylindrical coordinate values of a shape of the frame grooves, to thereby measure a frame shape of this spectacle frame. Then, a measurement result is outputted to the terminal computer 101 as frame shape data of this spectacle frame. The spectacle frame measuring machine 102 is configured to use a previously set measurement reference point as a reference, when the frame shape data is measured. The measurement reference point will be described in detail later.

At the side of the spectacle shop 100 where the terminal computer 101 and the spectacle frame measuring machine 102 are installed, frame shape data of a spectacle frame desired by a client is measured by the spectacle frame measuring machine 102. Then, the frame shape data measured by the spectacle frame measuring machine 102 is outputted to the terminal computer 101 from the spectacle frame measuring machine 102, and when a prescription value, etc., of the spectacle lens, which is desired by a client, is inputted, the terminal computer 101 transmits these contents online to the main frame 201 at the factory 200 side via the public communication line network 300.

(Factory Side Structure)

Meanwhile, the main frame 201 is installed at the factory 200 side, so as to connect to the terminal computer 101 at the spectacle shop side 100 via the public communication line network 300. The main frame 201 has a function as a computer device for executing a spectacle lens edging design program and a beveling design program, etc., and is configured to perform arithmetic operation of a lens shape including a bevel shape based on the data inputted from the terminal computer 101 at the spectacle shop 100 side. Further, the main frame 201 is connected to a plurality of terminal computers 210, 220, 230, 240, 250, which are installed at the factory 200 side, via LAN 202, in addition to the public communication line network 300, so that an operation result of the lens shape is transmitted to each of the terminal computers 210, 220, 230, 240, 250.

A roughing machine (curve generator) 211 and a smoothing polishing machine 212 are connected to the terminal computer 210. Then, the terminal computer 210 controls the roughing machine 211 and the smoothing polishing machine 212 while following the operation result transmitted from the main frame 201, to thereby perform curved surface finish of a rear surface (back surface) of a front surface edged lens.

A lens meter 221 and a thickness meter 222 are connected to the terminal computer 220. Then, the terminal computer 220 compares a measurement value obtained by the lens meter 221 and the thickness meter 222, and the operation result transmitted from the main frame 201, and performs a receiving inspection of the spectacle lens that has undergone the curved surface finish of the lens rear surface (back surface), and assigns a mark (three point mark) to an accepted lens showing an optical center.

A marker 231 and an image processing machine 232 are connected to the terminal computer 230. Then, the terminal computer 230 controls the marker 231 and the image processing machine 232 while following the operation result transmitted from the main frame 201, to thereby determine a blocking position for blocking (holding) a lens when edging and beveling are performed to the spectacle lens, and assign a blocking position mark. A jig and a tool for blocking are fixed to the lens, in accordance with such a blocking position mark.

A lens edger 241 for NC-control and a chuck interlock 242 are connected to the terminal computer 240. Then, the terminal computer 240 controls the lens edger and performs edging and beveling, based on the operation result transmitted from the main frame 201. Note that a previously set beveling instruction reference point is used as a reference when the beveling instruction is given to the lens edger 241. The beveling instruction reference point will be described in detail later.

A shape measuring device 251 measuring a top point of a bevel is connected to the terminal computer 250. Then, the terminal computer 250 controls the shape measuring device 251, to thereby cause this shape measuring device 251 to measure the circumference and the shape of the beveled spectacle lens, and compares the measurement result and the operation result transmitted from the main frame 201, to thereby judge defect and non-defect of the beveling process.

At the factory 200 side having the above-mentioned structure, the main frame 201 performs arithmetic operation of a spectacle lens shape including the bevel shape, based on input data transmitted from the terminal computer 101 at the spectacle shop 100 side, and each of the terminal computers 210, 220, 230, 240, 250 controls the lens edger 241 and the shape measuring device 251, etc., based on the operation result, to thereby manufacture the spectacle lens already beveled, with the bevel circumference matching the circumference of the spectacle frame.

Note that in the supply system of the spectacle lens having the above-mentioned a structure, as will be described later in detail, the method of edging a spectacle lens according to the present invention is executed mainly by at least one of the spectacle frame measuring machine 102, the lens edger 241, and the main frame 201 having a function as a computer device, the terminal computer 101 and the terminal computer 240. Namely, the function as the spectacle lens edging system according to the present invention is realized by them.

<2. Functional Structure>

Next, in the supply system of the spectacle lens having the above-mentioned structure, explanation will be given for a functional structure for executing the method of edging a spectacle lens according to the present invention.

(Spectacle Frame Measuring Machine)

The spectacle frame measuring machine 102 that measures a frame shape of the spectacle frame and outputs the frame shape data, will be described first.

The spectacle frame measuring machine 102 includes a probe which is brought into contact with frame grooves (bevel grooves) of right and left frames of the spectacle frame to be measured. Then, the frame shape of the spectacle frame is measured using this probe, and a measurement result thereof is outputted as the frame shape data of this spectacle frame. When the measurement result is outputted by the spectacle frame measuring machine 102 as the frame shape data, a center coordinate of a toric surface, base radius, cross radius, unit vector in a direction of a rotational symmetry axis of the toric surface, or a frame curve (curvature of a spherical surface when a frame is positioned on the spherical surface), circumference of the bevel groove, frame PD (inter-pupils distance), frame nose width, A-size and B-size being a maximum width of right and left and upper and lower parts of the frame, an effective diameter (double value of a maximum radius vector), and an inclination angle, etc., being an angle formed by the right and left frames, can be specified, under control of the terminal computer that receives the frame shape data.

Further, the spectacle frame measuring machine 102 uses a previously set measurement reference point as a reference, when the frame shape data is measured. The measurement reference point is a point to clarify a contact mode of the probe of the spectacle frame measuring machine 102 in contact with the frame groove of the spectacle frame, and a point uniquely determined from the position of the probe.

Figure 2:
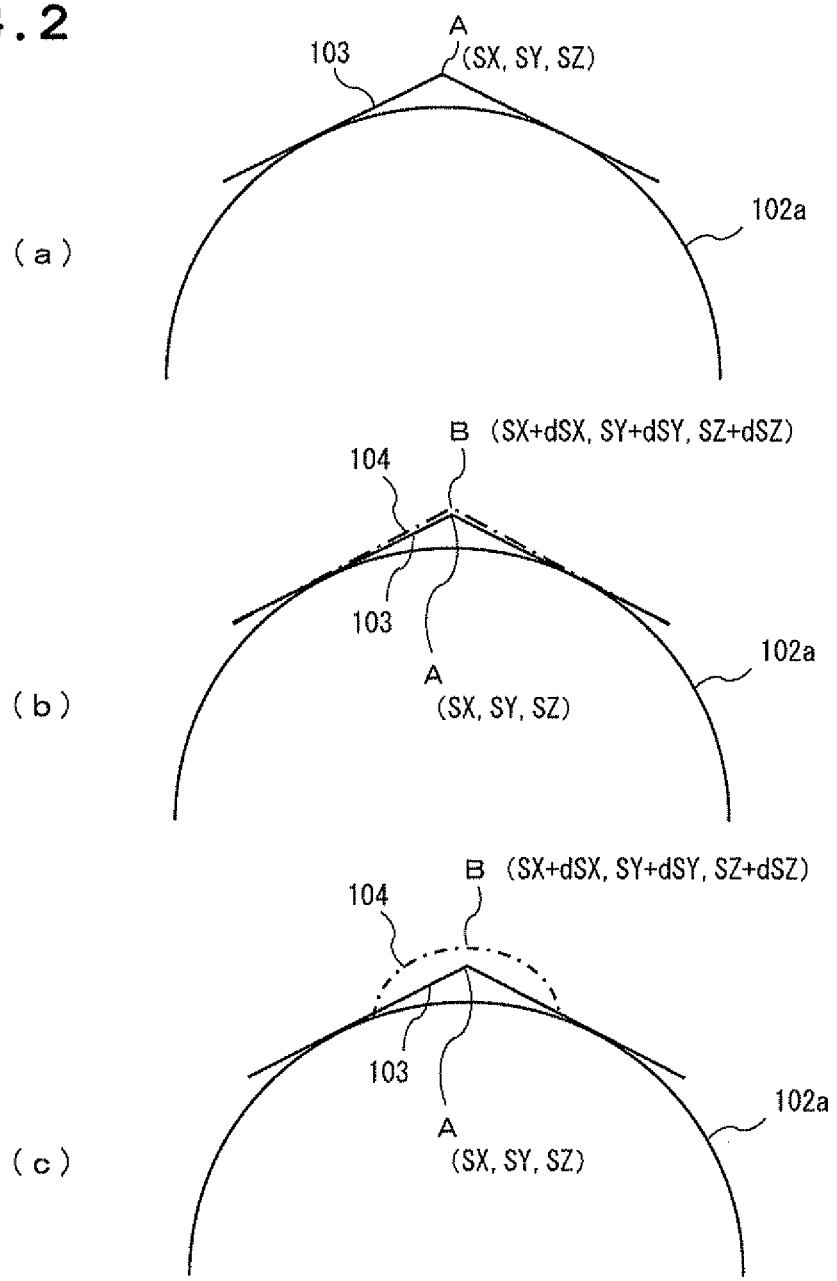
FIG. 2 is an explanatory view showing a specific example of a measurement reference point used in a spectacle frame measuring machine in the supply system of FIG. 1.

FIG. 2 is an explanatory view showing a specific example of the measurement reference point. In FIG. 2(*a*), the following case is assumed: the spectacle frame measuring machine 102 having a probe 102*a* with a spherical tip measures a virtual tip position of the bevel (called a "virtual bevel tip position" hereafter) when the bevel with a bevel angle of 120° is brought into contact with the groove 103 with a bevel groove angle of 120°. Then, in a case of an example shown in the figure, a groove tip position of the bevel groove 103 and the tip position of the virtual bevel coincides with each other, and such a coincident position (namely the tip end position of the virtual bevel) is set as the measurement reference point (see point A in the figure). Namely, as shown in the figure, when the measurement reference point is set, the spectacle frame measuring machine 102 obtains a three-dimensional coordinate (SX, SY, SZ) of a uniquely determined measurement reference point (for example, the tip end position of the virtual bevel), from the position of the probe 102*a*. Then, based on the three-dimensional coordinate value (Sx, SY, SZ), a diameter directional size of the frame shape (for example, distance from a frame center) and the circumference, etc., are calculated. Thus, the measurement reference point is a point for showing the locus employed by the probe 102*a* for clearly specifying which position the probe 102*a* passes.

The measurement referent point is not required to be set at a point where the groove tip position of the bevel groove and the virtual bevel tip position coincide with each other, and it is no problem in setting the measurement reference point A at a point where they don't coincide with each other. Even in a case that the measurement reference point A is set at a point where they don't coincide with each other, the groove tip position of the bevel groove can be obtained by a geometric arithmetic operation from the three dimensional coordinate values (SX, SY, SZ) of the measurement reference point A, if a groove angle and a detailed groove sectional shape, etc., of the frame groove of the spectacle frame is known.

Incidentally, the shape of the probe 102*a* and the setting position, etc., of the measurement reference point are not variable but fixed. Meanwhile, regarding the groove shape of the spectacle frame to be measured, equalization is not necessarily achieved, and various groove shapes (V-shaped groove or U-shaped groove, etc.) exist. Therefore, as shown in FIG. 2(*b*), in a case of the V-shaped groove for example, the positional relation between the groove tip position B and an actually measured virtual bevel tip position A is different, if the bevel groove 104 with a groove angle of 118° is measured by the spectacle frame measuring machine 102 on the assumption that the virtual bevel tip position is measured by the spectacle frame measuring machine 102, regarding the bevel with a bevel angle of 120°. Namely, deviation is generated between the groove tip position B and the virtual bevel tip position A by a portion of three dimensional coordinate values (dSX, dSY, dSZ), thus generating a difference (error) in grasping the frame shape data. Regarding the U-shaped groove, a specific example thereof is shown in FIG. 2(*c*).

This can also be said not only for the difference in the spectacle frame, but also for the difference in the type of the spectacle frame measuring machine 102. It is general that the shape of the probe 102*a* of the spectacle frame measuring machine 102 is different depending on the type, and which locus of the probe 102*a* passing through a certain position is employed as the measurement reference point (for example, whether the locus is the position coincident with the groove tip position, or the position different from the groove tip position), is also different depending on the type. Accordingly, even in a case of the same groove shape of the spectacle frame to be measured, the following matter can occur: namely, the positional relation between the estimated groove tip position and the actually measured virtual tip position is different, if the measurement is performed using the spectacle frame measuring machine of a different type.

An influence by the difference of the frame shape data as described above, will be described in detail, to solve this problem.

(Lens Edger)

Subsequently, explanation will be given for the lens edger 241 that applies an edging process and a beveling process, to the spectacle lens.

The lens edger 241 is a polishing device for NC-control having a rotating grinder for polishing to perform edging and beveling to the spectacle lens under control to move in the Y-axis direction (vertically in a spindle axis direction, and capable of performing at least 3-axis control of a rotation angle control (in a spindle axis rotating direction) of the block jig and tool to which a lens is fixed, and Z-axis control to move a grind stone or a spectacle lens in Z-axis direction (spindle axis direction) to perform beveling.

Figure 3:
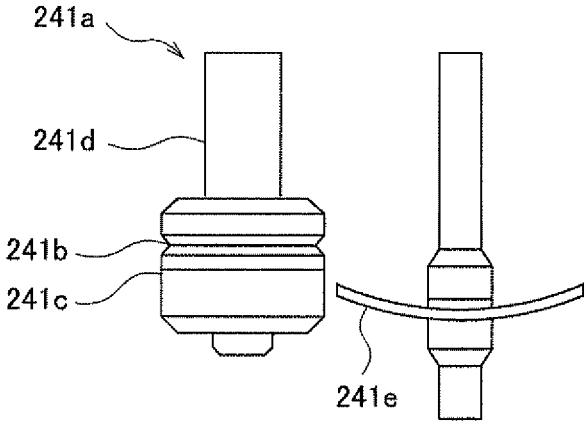
FIG. 3 is an explanatory view showing an example of a rotating grinding tool used for beveling by a lens edger in the supply system of FIG. 1.

FIG. 3 is an explanatory view showing an example of the rotating grinding tool used by the lens edger 241 for the beveling process. A rotating grinding stone 241*a* shown in the figure includes a grinding stone part 241*c* having a bevel groove 241*b* formed so as to correspond to a beveling slope at the lens front surface side and a beveling slope at a lens rear surface side respectively. By moving the rotating grinding stone 241*a* along a lens circumferential edge while rotating it around a rotation axis 241*d*, the beveling is performed to an overall circumference of a spectacle lens 241*e*.

The main frame 201 calculates the locus of the movement of the rotating grinding tool 241*a* along the lens circumferential edge. The main frame 201 performs arithmetic operation of a beveling design by starting a beveling design program. Namely, based on the input data from the terminal computer 101 at the spectacle shop 100 side, the arithmetic operation of a three-dimensional beveling design is performed, to thereby calculate a shape of a final three-dimensional bevel tip, and based on such a calculated three-dimensional bevel tip shape, three-dimensional beveling locus data on a beveling coordinate is calculated, for polishing and edging the lens using the rotating grinding tool 241*a* having a prescribed radius. The three-dimensional beveling locus data is obtained for giving a beveling instruction to the lens edger 241.

Incidentally, regarding the lens edger 241, if its type and the used rotating grinding tool 241*a*, etc., are different, the bevel shape obtained by beveling, particularly a bevel top angle (120°, 118°, etc.) is also different. Also, if the type of the lens edger 241 is different, a manner of giving a beveling instruction to the lens edger 241 is also different. More specifically, when the beveling instruction is given, which position is selected to define the beveling size (bevel circumference, etc.), namely at which position the beveling instruction is given as a reference, is also different. Namely, when the beveling instruction is given to the lens edger 241 based on the three-dimensional edging locus data, the instruction is given, with a previously set beveling instruction reference point as a reference. Then, such a beveling instruction reference point is a uniquely determined reference point depending on the type of the lens edger 241, and its content is different if the type is different.

Figure 4:
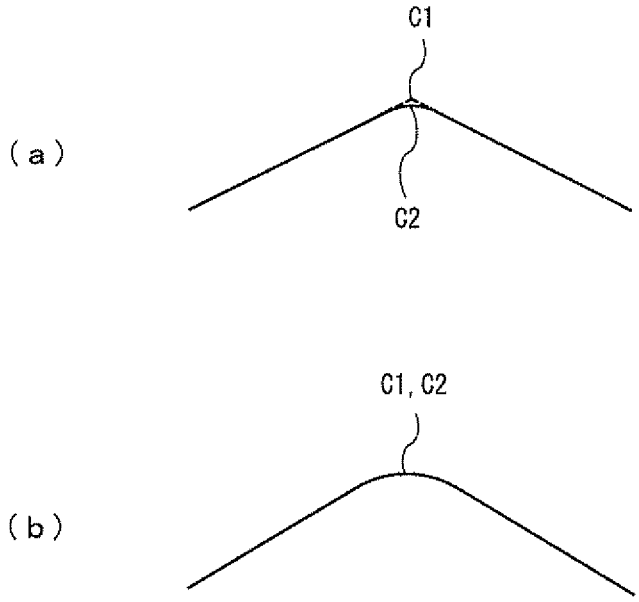
FIG. 4 is an explanatory view showing a specific example of a beveling instruction reference point used by the lens edger in the supply system of FIG.

FIG. 4 is an explanatory view showing a specific example of the beveling instruction reference point.

It can be considered that the position of the bevel top after forming the bevel by beveling is used as the beveling instruction reference point. Namely, the three-dimensional coordinate value of the top position of the bevel to be formed, is obtained on a certain edged sectional face, and NC-control is performed to the lens edger 241 so that the position of the three-dimensional coordinate value corresponds to the bevel top position.

However, as described above, the content of the beveling instruction reference point is different, if the type of the lens edger 241 is different.

For example, the specific example shown in FIG. 4(*a*) shows a case that a bevel top position (called a "beveling position" hereafter) C1 in a designed bevel shape obtained by executing a beveling design program by the main frame 201, is set as the beveling instruction reference point. Accordingly, when the beveling instruction is given based on the three-dimensional beveling locus data, the beveling size such as a diameter direction size of the bevel (for example, distance from a frame center to the bevel top) and the bevel circumference, etc., is defined, with the bevel top position as a reference. However, even if the beveling is performed with such a beveling instruction reference point as a reference, the bevel top portion is rounded by cutting, if the beveling is performed using the rotating grinding tool 241*a* actually, and the deviation is probably generated between the bevel top position which is actually formed (called "actual bevel position" hereafter) C2 and a beveling position C1. Namely, the beveling position C1 and the actual bevel position C2 are different from each other, thus generating the deviation between them, thereby inviting an adverse influence on the beveling precision in the beveling process.

Further, for example the specific example shown in FIG. 4(*b*) shows a case that the beveling instruction reference point is set so that the beveling position C1 and the actual bevel position C2 coincide with each other. In this case, when the beveling instruction is given to the lens edger based on the three-dimensional beveling locus data, the beveling precision in the beveling process is probably adversely influenced, unless the instruction is given in consideration of not the designed bevel shape, but a rounded potion which is rounded by cutting.

Accordingly, even if the bevel shape to be formed is the same, the following matter probably occurs: namely, an actually formed size of the bevel (bevel circumference, etc.) is different from an estimated size, when the beveling is performed using the lens edger 241 of a different type (for example, a case shown in FIG. 4(*a*) and FIG. 4(*b*) respectively).

Such an adverse influence on the edging precision in the edging process will be described later in detail, wherein the above-mentioned problem is solved.

(Mechanical Structures of the Main Frame and the Terminal Computer)

Subsequently, a functional structure of at least one of the main frame 201, the terminal computer 101, and the terminal computer 240 will be described in detail. The main frame 201, the terminal computer 101, and the terminal computer 240 are provided for giving the instruction of beveling the spectacle lens, to the lens edger 241 based on the frame shape data outputted from the spectacle frame measuring machine 102, and function as controllers of the present invention. Here, for example explanation is given for a case that each function described below is collectively arranged in the terminal computer 240. However, each function described below may be arranged not in the terminal computer 240, but collectively in the main frame 201 or the terminal computer 101, or may be dispersedly arranged in a plurality of them.

Figure 5:
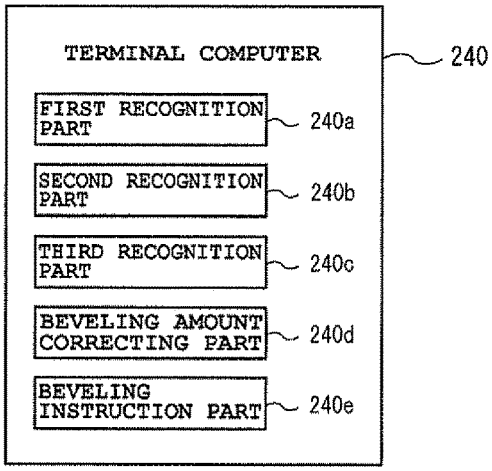
FIG. 5 is a block diagram showing an example of a functional structure of a terminal computer in the supply system of FIG. 1.

FIG. 5 is a block diagram showing the function structure of the terminal computer 240.

As shown in the figure, the terminal computer 240 has a function as a first recognition part 240*a*, a second recognition part 240*b*, a third recognition part 240*c*, a beveling amount correcting part 240*d*, and a beveling instruction part 240*e*. These parts 240*a* to 240*e* will be sequentially described hereafter.

The first recognition part 240*a* recognizes the positional relation between the groove shape of the spectacle frame whose frame shape data is measured by the spectacle frame measuring machine 102, and the measurement reference point being the reference when measuring the frame shape data. Such a recognition may be performed based on the data inputted by the terminal computer 101 (particularly the data for specifying the groove shape and the groove angle, etc., of the spectacle frame), and the data for specifying a specification of the spectacle frame measuring machine (particularly the data for specifying the position of the measurement reference point such as a probe shape, etc.). Acquisition of such data may be performed by accessing the terminal computer 101 at the spectacle shop 100 side or the spectacle frame measuring machine 102, etc., or by accessing a database not shown provided for collectively managing these data at the factory 200 side.

The second recognition part 240*b* recognizes the positional relation between the beveling instruction reference point being the reference when the beveling instruction is given to the lens edger 241, and the bevel shape obtained by such a beveling. Such a recognition may be performed based on the data for specifying the specification of the lens edger 241 (particularly the data, etc., for specifying the position of the beveling instruction reference point or the data for specifying the used rotating grinding tool 241*a*, and so forth). Such an acquisition of the data may be performed by accessing the terminal computer 240 at the factory 200 side and the lens edger 241, etc., or by accessing the database not shown provided for collectively managing these data at the factory 200 side.

The third recognition part 240*c* recognizes a fitting mode between the groove shape of the spectacle frame whose frame shape data is measured by the spectacle frame measuring machine 102, and the bevel shape obtained by beveling performed by the lens edger 241 based on the recognition result in the first recognition part 240*a* and the recognition result in the second recognition part 240*b*. As will be described later in detail, the recognition of the fitting mode may be performed based on each relative positional relation.

The beveling amount correcting part 240*d* corrects a beveling amount when the beveling instruction is given to the lens edger 241 based on the recognition result in the third recognition part 240*c*, in consideration of a manner of giving the beveling instruction to the lens edger 241 so that the bevel shape obtained by beveling by the lens edger 241 is fitted into the groove shape of the spectacle frame whose frame shape data is measured by the frame measuring machine 102.

The beveling instruction part 240*e* gives the beveling instruction to the lens edger 241, using the three-dimensional edging locus data prepared by the main frame 201. Wherein, the beveling instruction part 240*e* gives the beveling instruction to the lens edger 241, while reflecting the content corrected by the beveling amount correcting part 240*d*. Namely, the beveling instruction is given to the lens edger 241 based on the beveling amount after being corrected by the beveling amount correcting part 240*d*.

(Spectacle Lens Edging Program)

Each of the parts 240*a* to 240*e* described above is realized by executing a spectacle lens edging program being a prescribed program by the terminal computer 240 (or the main frame 201, the terminal computer 101) having the function as a computer device. The spectacle lens edging program is used by being installed in a memory device such as a terminal computer 240, etc. However, prior to such an install, the spectacle lens edging program may be provided to the terminal computer 240, etc., via the public communication line network 300 connected to the main frame 201, or may be provided by being stored in a memory medium readable by the terminal computer 240, etc.

<3. Procedure of a Method of Edging a Spectacle Lens>

Next, explanation will be given for a procedure of a method of edging a spectacle lens according to this embodiment, with a specific example.

Figure 6:
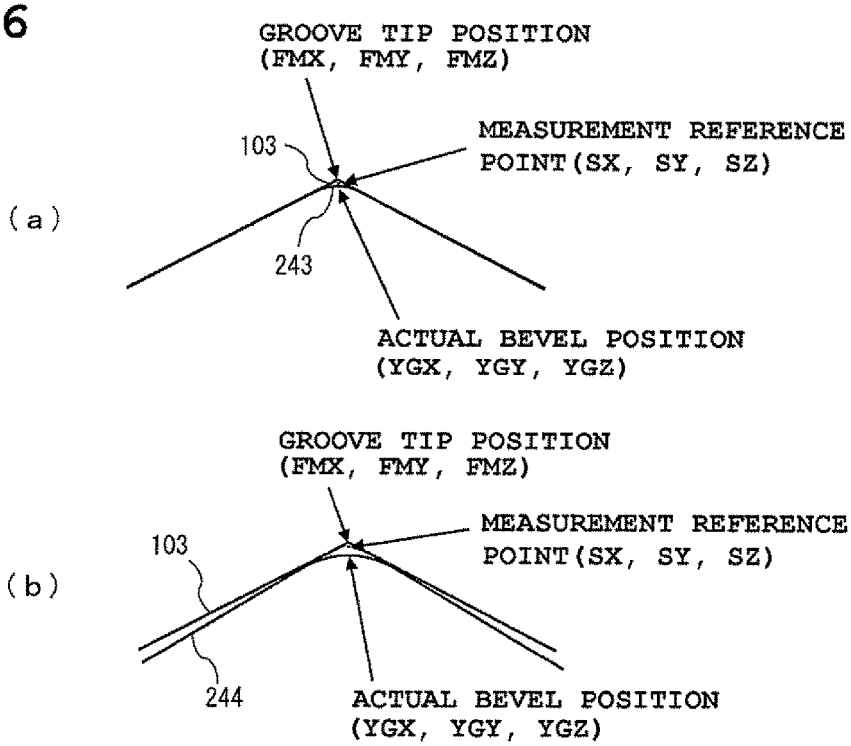
FIG. 6 is an explanatory view showing an outline of a specific example of a method of edging a spectacle lens according to the present invention.

FIG. 6 is an explanatory view showing an outline of the specific example of the method of edging a spectacle lens according to the present invention.

Here, the first specific example, the second specific example, and the third specific example are given as specific examples. In the first specific example, explanation is given for a case that the groove shape of the spectacle frame is the V-shaped groove, with its groove angle being 118°, and a virtual bevel top angle being the reference of measuring the spectacle frame is 120°, and meanwhile the bevel top angle in the bevel shape edged by the lens edger 241 is 118°, namely, the groove angle of the spectacle frame and the bevel top angle is the same. In the second specific example, explanation is given for a case that the groove shape of the spectacle frame is the V-shaped groove, with its groove angle being 118°, and the virtual bevel tip angle being the reference of measuring the spectacle frame is 120°, and meanwhile the bevel top angle in the bevel shape edged by the lens edger 241 is 110°, namely the groove angle of the spectacle frame and the bevel top angle are different from each other. Further, in the third specific example, explanation is given for a case that an inclination is generated between the groove shape of the spectacle frame and the bevel shape.

(First Specific Example)

First, the first specific example of the method of edging a spectacle lens will be described.

In the first specific example, edging of the spectacle lens is performed through a first recognizing step (step 1: abbreviated as "S" hereafter), a second recognizing step (S2), a third recognizing step (S3), a beveling amount correcting step (S4), and a beveling instruction step (S5) sequentially.

(S1; First Recognizing Step)

In the first recognizing step, the first recognition part 240*a* recognizes the positional relation between the groove shape of the spectacle frame whose frame shape data is measured, and the measurement reference point being the reference when measuring the frame shape data. Specifically, as shown in FIG. 6(*a*), when a certain measurement sectional face is taken into consideration, the three-dimensional coordinate values (SX, SY, SZ) of the measurement reference point uniquely determined by the type of the spectacle frame measuring machine 102 (for example, the virtual bevel tip position of the bevel with a bevel angle of 120°) is grasped, and the positional relation between the measurement reference point and the groove shape of the spectacle frame is recognized, and based on such a recognition result, the three-dimensional coordinate values (FMX, FMY, FMZ) of the groove tip position of the bevel groove 103 of this spectacle frame is obtained. When the measurement reference point coincides with the groove tip position, the three-dimensional coordinate values are the same respectively. However, when the measurement reference point is set at a position different from the groove tip position, the three-dimensional coordinate values (FMX, FMY, FMZ) at the groove tip position may be obtained from the three-dimensional coordinate values (SX, SY, SZ) at the measurement reference point, by the arithmetic operation. Information regarding the coordinate values obtained here and the relative positional relation is stored and held by the memory device (not shown) that can be accessed by the third recognition part 240*c*.

(S2; Second Recognizing Step)

In the second recognizing step (S2), the second recognition part 240*b* recognizes the positional relation between the beveling instruction reference point being the reference when giving the beveling instruction to the lens edger 241, and the bevel shape obtained by such a beveling process. Specifically, as shown in FIG. 4(*a*), when a certain edged sectional face is taken into consideration, the beveling instruction point which is uniquely determined by the type of the lens edger 241 is grasped, and the shape of the rotating grinding tool 241*a* used for the beveling process is grasped, so that the relative positional relation between the bevel shape obtained by performing the beveling process using the rotating grinding tool 241*a* and the beveling instruction reference point (for example, the relation between the beveling position C1 and the actual bevel position C2) is recognized. The information regarding the relative positional relation, etc., recognized here, is stored and held by the memory device (not shown) that can be accessed by the third recognition part 240*c*.

(S3; Third Recognizing Step)

In the third recognizing step (S3), the third recognition part 240*c* recognizes the fitting mode between the groove shape of the spectacle frame whose frame shape data is measured by the spectacle frame measuring machine 102, and the bevel shape obtained by the beveling process performed by the lens edger 241, based on the recognition result in the first recognizing step (S1) and the recognition result in the second recognizing step (S2). Specifically, as shown in FIG. 6(*a*), first, regarding a certain edged sectional face, the recognition result in the first recognizing step (S1) and the recognition result in the second recognizing step (S2) are read. Then, from these recognition results, the contact mode of the bevel shape 243 obtained by the beveling process in contact with the groove shape of the spectacle frame, namely, the fitting mode between them is recognized. More specifically, the position of the groove shape of the spectacle frame is determined from the relative positional relation between the three-dimensional coordinate values (SX, SY, SZ) at the measurement reference point, and the three-dimensional coordinate values (FMX, FMY, FMZ) at the groove tip position, and the three-dimensional coordinate values (YGX, YGY, YGZ) at the actual bevel position when the bevel shape obtained by beveling is brought into contact with the groove shape of the spectacle frame, are obtained by computation.

In the first specific example, the groove angle of the spectacle frame and the bevel top angle are 118° and the same. Therefore, for example, the third recognition part 240*c* may recognize the fitting mode between them by obtaining an overlapped point of corresponding oblique sides in each shape.

(S4; Beveling Amount Correcting Step)

In the beveling amount correcting step (S4), the beveling amount correcting part 240*d* corrects the beveling amount when giving the beveling instruction to the lens edger 241 based on the recognition result in the third recognizing step (S3), so that the bevel shape obtained by beveling is fitted into the groove shape of the spectacle frame. Specifically, the three-dimensional coordinate values (YGX, YGY, YGZ) at the actual bevel position regarding a certain beveled sectional face are obtained in the above-mentioned third recognizing step (S3). Therefore, the beveling position corresponding to the three-dimensional coordinate values (YGX, YGY, YGZ) is obtained from the three-dimensional coordinate values (YGX, YGY, YGZ) and the relative positional relation (for example the relation between the beveling position and the actual bevel position) recognized in the second recognizing step (S2).

(S5; Beveling Instruction Step)

In the beveling instruction step (S5), the beveling instruction part 240*e* gives the beveling instruction to the lens edger 241 in a state that the beveling amount after being corrected in the beveling amount correcting step (S4) is reflected on the three-dimensional beveling locus data (namely, in a state that the beveling position obtained in the beveling amount correcting step (S4) is reflected on the three-dimensional beveling locus data), while using the three-dimensional beveling locus data prepared by the main frame 201. Specifically, the beveling position obtained in the beveling amount correcting step (S4) is set as the beveling instruction reference point, and with this beveling instruction reference point as a reference, the beveling size such as a diameter direction size of the bevel and the circumference of the bevel, or the like is defined, to thereby give the instruction of beveling to the lens edger based on the three-dimensional beveling locus data. Namely, the position of the bevel top when the bevel shape is brought into contact with the groove shape of the spectacle frame is obtained, based on the recognition result of the positional relation between the measurement reference point of the spectacle frame measuring machine 102 and the groove shape of the spectacle frame, and the bevel shape obtained by the beveling process performed by the lens edger 241, and the beveling size in the beveling process is aligned in consideration of a size alignment method for each type of the lens edger 241 (namely a setting position of the beveling instruction reference point), so that the actual bevel position coincides with the position of the bevel top. Then, the instruction of beveling is given to the lens edger.

The lens edger 241 performs the beveling process in accordance with the beveling instruction given from the beveling instruction part 240*e* as described above. Accordingly, the influence by the difference in grasping the frame shape data by the spectacle frame measuring machine 102 described in the above-mentioned <2. Functional structure>, and the adverse influence on the beveling precision in the beveling process by the lens edger 241, can be solved by correcting the beveling amount in the beveling amount correcting step (S4).

(Second Specific Example)

Subsequently, a second specific example of the method of edging a spectacle lens will be described.

In the second specific example as well, similarly to the above-mentioned first specific example, the spectacle lens is edged through the first recognizing step (S1), the second recognizing step (S2), the third recognizing step (S3), the beveling amount correction step (S4), and the edging instruction step (S5) sequentially.

However, in the second specific example, unlike the case of the first specific example, as shown in FIG. 6(*b*) the groove angle (specifically 118°) of the bevel groove 103 of the spectacle frame, and the bevel top angle (specifically 110°) of the bevel shape 244 obtained by beveling, are different from each other. Then, in the third recognizing step (S3), the third recognition part 240*c*, for example, performs shape simulation processing of relatively moving the sectional shapes of the groove angle and the bevel top angle in the second specific example. Then, in the second specific example, the fitting mode between the groove angle and the bevel top angle may be recognized by obtaining two points where both shapes are firstly brought into contact with each other when each figure approaches each other in a state of facing each other.

Other processing is the same as the case of the first specific example, and therefore explanation therefore is omitted.

In the second specific example as described above as well, the beveling amount is corrected in the beveling amount correcting step (S4). Therefore, similarly to the first specific example, the influence of the difference in grasping the frame shape data and the adverse influence on the beveling precision in the beveling process can be solved. Particularly in the second specific example, even in a case that the groove angle of bevel groove 103 and the bevel top angle of the bevel shape 244 are different, the beveling amount is corrected in consideration of the difference between the groove angle and the bevel top angle. Therefore, the groove shape of the spectacle frame, the type of the spectacle frame measuring machine 102, and the type of the lens edger 241, etc., can be variously combined to be used.

(Third Specific Example)

Subsequently, the third specific example of the method of edging a spectacle lens, will be described.

In the third specific example as well, similarly to the first specific example and the second specific example, the edging of the spectacle lens is performed through the first recognizing step (S1), the second recognizing step (S2), the third recognizing step (S3), the beveling amount correcting step (S4), and the beveling instruction step (S5) sequentially.

Incidentally, in either case of the first specific example and the second specific example, it is assumed that the bevel shape is brought into contact with the groove shape of the spectacle frame in a state that they are faced each other. However, the groove shape of the spectacle frame and the bevel shape are not necessarily brought into contact with each other in a state of facing each other, and can be brought into contact with each other in a state of inclination in some cases. Therefore, in the third specific example, the third recognition part 240*c* recognizes the fitting mode between them in the third recognizing step (S3), in consideration of an inclination amount generated between the groove shape of the spectacle frame and the bevel shape.

In order to recognize the fitting mode, prior to the third recognition step (S3), the inclination amount between the groove shape of the spectacle frame and the bevel shape is recognized, at least in one of the first recognizing step (S1) and the second recognizing step (S2). The "inclination amount" called here is an amount of specifying how much inclination is generated in the groove shape or the bevel shape, compared with the state that the groove shape of the spectacle frame and the bevel shape are faced each other. Such an inclination amount includes for example an amount expressed by an inclination angle of the groove shape, or an inclination amount of the bevel shape with respect to an edging axis, or a composite amount of both of them. However, other amount may also be used, provided that a relative inclination between the groove shape of the spectacle frame and the bevel shape can be specified.

Figure 7:
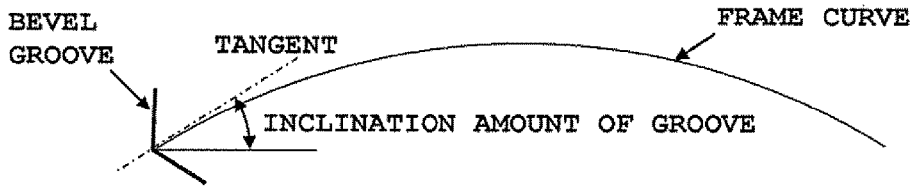
FIG. 7 is an explanatory view showing a specific example of en estimation technique of an inclination amount of a groove in the method of edging a spectacle lens according to the present invention.

The inclination amount is probably recognized by utilizing a measurement result of the frame shape of the spectacle frame measured by the spectacle frame measuring machine 102. The type of the spectacle frame measuring machine 102 includes the one capable of measuring various groove shapes (V-groove shape and U-groove shape, etc.). This is because the inclination amount between the groove shape of the spectacle frame and the bevel shape can be quantitatively measured by using the spectacle frame measuring machine 102 of such a type. There is also a technique of estimating the inclination amount from the frame shape of the spectacle frame. Specifically, as shown in FIG. 7, the inclination amount in a tangent direction of a frame curve spherical surface at a position of the frame shape, is estimated from a value of the frame curve of the spectacle frame. The inclination amount may also be recognized by using other technique like the above-mentioned technique.

When the inclination amount is recognized, thereafter, the fitting mode between the groove shape of the spectacle lens and the bevel shape is recognized in the third recognizing step (S3) in consideration of the recognized inclination amount. Specifically, in the third recognizing step (S3), the third recognition part 240*c* performs shape simulation processing of relatively moving the sectional shapes of the groove shape and the bevel shape, wherein either one of the shapes is inclined by an inclination amount recognized at this time. Then, in this state, both shapes are approached each other, and the contact mode of them may be obtained, to thereby recognize the fitting mode between the groove shape and the bevel shape.

In the third specific example as described as well, the beveling amount is corrected in the beveling amount correcting step (S4). Therefore, similarly to the first specific example or the second specific example, the adverse influence on the precision of measuring the frame shape data and the adverse influence on the precision in the beveling process can be solved. Further, in the third specific example, the inclination amount between the groove shape of the spectacle frame and the bevel shape is taken into consideration. Therefore, the third specific example can suitably respond to spectacle frames of various types (even in a case of the spectacle frame for example in which a three-dimensional clination is generated in the groove shape).

<4. Effect of this Embodiment>

According to the method of edging a spectacle lens, the spectacle lens edging system and the spectacle lens edging program described in this embodiment, the following effect can be obtained.

In this embodiment, the beveling amount in the beveling process is corrected by recognizing an actual fitting mode between the groove shape of the spectacle frame and the bevel shape after beveling, in comprehensive consideration of a series of processing from acquisition of the frame shape data of the spectacle frame, to giving instruction of beveling to the lens edger 241. Accordingly, even in a case that the deviation, etc., is generated in the estimated positional relation, due to the groove shape of the spectacle frame, the type of the spectacle frame measuring machine 102 to be used, and the type of the lens edger 241 to be used, etc., the adverse influence on the precision of measuring the frame shape data and precision in the beveling process caused by such a deviation, etc., can be solved by correcting the beveling amount in the beveling process while recognizing the actual fitting mode. Namely, even in a case of any kind of the combination of the groove shape of the spectacle frame, the type of the spectacle frame measuring machine 102 to be used, and the type of the lens edger 241 to be used, the beveling process capable of obtaining the bevel shape that can be precisely fitted into the groove shape of the spectacle frame, can be performed, without being influenced by the difference in the groove angle shape or the type of the spectacle frame measuring machine or the lens edger. As a result, the fitting ratio into the spectacle frame of the spectacle lens after beveling can be improved.

As described above, according to this embodiment, in supplying the spectacle lens with a bevel, a complicated work such as alignment of an edging size by an actual body alignment is not required for precisely fitting the spectacle lens after beveling into the spectacle frame, even in any kind of combination of the groove shape of the spectacle frame, the type of the spectacle frame measuring machine 102 to be used, and the type of the lens edger 241 to be used. Further, the actual body alignment process in accordance with the above combination is not interposed. Therefore, a product management and a management of the edging steps are not complicated. Further, flexibility or a general purpose of use, etc., can be secured, such as the edging interrupted in the middle of the edging step is consecutively performed by the lens edger of other type. Moreover, when a failure in the edging size is generated under such a circumstance, it becomes easier to cope with the size failure than conventional by specifying the cause of the size failure.

Namely, according to this embodiment, the fitting ratio into the spectacle frame of the spectacle lens after beveling can be improved, and the beveled spectacle lens can be supplied with a stable quality.

Further, according to this embodiment, when the actual fitting mode between the groove shape of the spectacle frame and the bevel shape after beveling is recognized, the inclination amount between the groove shape and the bevel shape is taken into consideration. Accordingly, the fitting ratio into the spectacle frame of the spectacle lens after beveling can be improved, while suitably responding to the spectacle frames of various types (for example, to the spectacle frame in which the three-dimensional inclination is generated in the groove shape).

<5. Modified Example, Etc.>

Embodiments of the present invention are described above. However, the above-mentioned disclosed contents are exemplary. Namely, a technical scope of the present invention is not limited to the above-mentioned exemplary embodiments.

For example, the bevel shape, the shape of the rotating grinding tool 241*a*, and the shape of the stylus 251*a*, etc., given in the examples of this embodiment, are simply examples, and even in a case of other shape, the present invention can be completely similarly applied.

Further, in this embodiment, the following case is taken as an example. Namely, a certain individual estimated sectional face is focused, and the fitting mode between the groove shape of the spectacle frame and the bevel shape is recognized, and the beveling amount is corrected when giving instruction of beveling to the lens edger. However, the estimated sectional face is not necessarily the individual face, and a plurality of sectional faces may be provided at a plurality of places in the circumferential direction of the spectacle lens. Specifically, for example, it can be considered that the circumferential direction of the spectacle lens is divided by 1°, and the estimated sectional face is set at each point of 360 places. Then, the fitting mode between the groove shape of the spectacle frame and the bevel shape is recognized at each estimated face, to thereby determine the correcting amount of the beveling amount in the beveling process. Thus, even in a case that the correcting amount is different at each sectional face, the instruction of beveling can be given in consideration of a suitable correcting amount at each point.

What is claimed is:

1. A method of edging a spectacle lens that performs beveling to a spectacle lens using a lens edger based on frame shape data of a spectacle frame; comprising:

recognizing a positional relation between a groove shape of the spectacle frame whose frame shape data is measured and a measurement reference point being a reference when the frame shape data is measured, and a positional relation between a beveling instruction reference point being a reference when the beveling instruction is given to the lens edger and a bevel shape obtained by the beveling;

correcting a beveling amount so that the bevel shape is fitted into the groove shape based on the recognized each positional relation when the beveling instruction is given to the lens edger; and performing the beveling of the lens with the lens edger based on the beveling instruction which includes the corrected beveling amount such that the lens fits into the frame.

2. The method of edging a spectacle lens according to claim 1, wherein the beveling amount is corrected so that the bevel shape is fitted into the groove shape, in consideration of an inclination amount between the groove shape and the bevel shape.

3. A spectacle lens edging system, comprising:

a spectacle frame measuring machine configured to measure a frame shape of a spectacle frame and output frame shape data;

a lens edger configured to perform beveling to a spectacle lens;

a controller configured to give an instruction of beveling the spectacle lens, to the lens edger based on the frame shape data outputted from the spectacle frame measuring machine, the controller further comprising:

a recognition part that recognizes a positional relation between a groove shape of the spectacle frame whose frame shape data is measured, and a measurement reference point being a reference when measuring the frame shape data, and a positional relation between a beveling instruction reference point being a reference when a beveling instruction is given to the lens edger and a bevel shape obtained by the beveling; and a beveling amount correcting part that corrects a beveling amount based on each positional relation recognized by the recognition part, so that the bevel shape is fitted into the groove shape when the beveling instruction is given to the lens edger, the controller controlling the lens edger to perform the beveling of the lens based on the beveling instruction which includes the corrected beveling amount such that the lens fits into the frame.

4. A non-transitory computer readable recording medium recording a spectacle lens edging program, for causing a computer used by being connected to a spectacle frame measuring machine that measures a frame shape of a spectacle frame and outputs frame shape data, and a lens edger that performs beveling to a spectacle lens, to function as:

a beveling instruction part that gives an instruction of beveling the spectacle lens, to the lens edger based on the frame shape data outputted from the spectacle frame measuring machine;

a recognition part that recognizes a positional relation between a groove shape of the spectacle frame whose frame shape data is measured, and a measurement reference point being a reference when measuring the frame shape data, and a positional relation between a beveling instruction reference point being a reference when a beveling instruction is given to the lens edger and a bevel shape obtained by the beveling; and a beveling amount correcting part that corrects a beveling amount based on each positional relation recognized by the recognition part, so that the bevel shape is fitted into the groove shape when the beveling instruction is given to the lens edger, the computer controlling the lens edger to perform the beveling of the lens based on the beveling instruction which includes the corrected beveling amount such that the lens fits into the frame.

5. A method of edging a spectacle lens for performing beveling to a spectacle lens by a lens edger based on frame shape data of the spectacle frame, comprising:

a first recognizing step of recognizing a positional relation between a groove shape of the spectacle frame whose frame shape data is measured, and a measurement reference point being a reference when the frame shape data is measured;

a second recognizing step of recognizing a positional relation between a beveling instruction reference point being a reference when a beveling instruction is given to the lens edger, and a bevel shape obtained by the beveling;

a third recognizing step of recognizing a fitting mode between the groove shape and the bevel shape, based on a recognition result in the first recognizing step, and a recognition result in the second recognizing step; and a beveling amount correcting step of correcting a beveling amount when the beveling instruction is given to the lens edger so that the bevel shape is fitted into the groove shape, based on a recognition result in the third recognizing step;

a beveling instruction step of giving an instruction of beveling, to the lens edger based on a beveling amount after being corrected in the beveling amount correcting step; and a beveling step of beveling the lens with the lens edger based on the beveling instruction which includes the corrected beveling amount such that the lens fits into the frame.

6. The method of edging a spectacle lens according to claim 5, wherein the fitting mode is recognized in the third recognizing step, in consideration of an inclination amount between the groove shape and the bevel shape.

7. A spectacle lens edging system, comprising:

a spectacle frame measuring machine configured to measure a frame shape of a spectacle frame and output frame shape data;

a lens edger configured to perform beveling to a spectacle lens; and a controller configured to give an instruction of beveling the spectacle lens, to the lens edger based on the frame shape data outputted from the spectacle frame measuring machine, the controller further comprising:

a first recognition part that recognizes a positional relation between a groove shape of the spectacle frame whose frame shape data is measured and a measurement reference point being a reference when measuring the frame shape data;

a second recognition part that recognizes a positional relation between a beveling instruction reference point being a reference when the beveling instruction is given to the lens edger, and a bevel shape obtained by the beveling;

a third recognition part that recognizes a fitting mode between the groove shape and the bevel shape, based on a recognition result in the first recognition part and a recognition result in the second recognition part;

a beveling amount correcting part that corrects a beveling amount based on a recognition result in the third recognition part, so that the bevel shape is fitted into the groove shape when the beveling instruction is given to the lens edger; and a beveling instruction part that gives the beveling instruction to the lens edger based on the beveling amount after being corrected in the beveling amount correcting part, the controller controlling the lens edger to perform the beveling of the lens based on the beveling instruction which includes the corrected beveling amount such that the lens fits into the frame.

8. A non-transitory computer readable recording medium recording a spectacle lens edging program, for causing a computer used by being connected to a spectacle frame measuring machine that measures a frame shape of a spectacle frame and outputs frame shape data, and a lens edger that performs beveling to a spectacle lens, to function as:

a first recognition part that recognizes a positional relation between a groove shape of the spectacle frame whose frame shape data is measured, and a measurement reference point being a reference when the frame shape data is measured;

a second recognition part that recognizes a positional relation between a beveling instruction reference point being a reference when a beveling instruction is given to the lens edger, and a bevel shape obtained by the edging;

a third recognition part that recognizes a fitting mode between the groove shape and the bevel shape, based on a recognition result in the first recognition part and a recognition result in the second recognition part;

a beveling amount correcting part that corrects a beveling amount based on a recognition result in the third recognition part, so that the bevel shape is fitted into the groove shape when the beveling instruction is given to the lens edger; and a beveling instruction part that gives the beveling instruction to the lens edger based on a beveling amount after being corrected by the beveling amount correcting part, the computer controlling the lens edger to perform the beveling of the lens based on the beveling instruction which includes the corrected beveling amount such that the lens fits into the frame.

9. A method of edging a spectacle lens that performs beveling to a spectacle lens using a lens edger based on frame shape data of a spectacle frame, comprising:

recognizing a first deviation between an actual point on a groove shape of the spectacle frame whose frame shape data is measured and a predetermined measurement reference point which corresponds to the actual point and is predetermined based on a predetermined bevel angle of a bevel shape of the spectacle lens, and a second deviation between a predetermined beveling instruction reference point which is predetermined based on both the frame shape data and a type of the lens edger and a corresponding point on the bevel shape obtained by the beveling;

correcting a beveling amount so that the bevel shape is fitted into the groove shape based on the recognized first and second deviations when the beveling instruction is given to the lens edger; and performing the beveling of the lens with the lens edger based on the beveling instruction which includes the corrected beveling amount such that the lens fits into the frame.

* * * * *